US007785393B2

(12) United States Patent
Pretorius

(10) Patent No.: US 7,785,393 B2
(45) Date of Patent: Aug. 31, 2010

(54) REFINEMENT OF STEEL

(75) Inventor: Eugene Pretorius, Mt. Pleasant, SC (US)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 12/434,140

(22) Filed: May 1, 2009

(65) Prior Publication Data

US 2009/0246068 A1 Oct. 1, 2009

Related U.S. Application Data

(63) Continuation of application No. PCT/US2007/083125, filed on Oct. 31, 2007.

(60) Provisional application No. 60/863,848, filed on Nov. 1, 2006.

(51) Int. Cl.
*C21C 7/064* (2006.01)

(52) U.S. Cl. ..... 75/384; 75/570

(58) Field of Classification Search ..... 75/570, 75/384

See application file for complete search history.

(56) References Cited

U.S. PATENT DOCUMENTS

| | | | | |
|---|---|---|---|---|
| 3,861,906 | A * | 1/1975 | Tipnis et al. | 420/84 |
| 4,152,140 | A * | 5/1979 | Hori et al. | 75/508 |
| 6,174,347 | B1 * | 1/2001 | Barker | 75/560 |
| 2008/0142123 | A1 * | 6/2008 | Takahashi et al. | 148/504 |

FOREIGN PATENT DOCUMENTS

| | | |
|---|---|---|
| JP | 60-162719 | 8/1985 |
| JP | 7316637 | 12/1995 |
| KR | 10-1991-0006278 | 8/1991 |
| KR | 10-1992-0004937 | 6/1992 |
| KR | 10-2005-0005622 | 1/2005 |

OTHER PUBLICATIONS

International Preliminary Report on Patentability in PCT/US2007/083125, dated May 14, 2009.

* cited by examiner

*Primary Examiner*—George Wyszomierski
*Assistant Examiner*—Tima M McGuthry-Banks
(74) *Attorney, Agent, or Firm*—Hahn Loesser + Parks LLP; Arland T. Stein

(57) ABSTRACT

A method of forming and refining molten silicon-bearing steel by addition of a calcium-containing silicon additive. Determine if the amount of calcium in the calcium-containing silicon additive is more or less than the amount of calcium desired in the finished steel. If it is more than the amount of calcium desired in the finished steel, add the amount of calcium-containing silicon additive corresponding to the excess calcium early during steel deoxidation or in refining to combine with oxygen, sulfur and other impurities in refining, and add the calcium-containing silicon additive containing the total amount of calcium desired in the finished steel after the desulfurization of the molten steel and before casting. If the amount of calcium in the calcium-containing silicon additive does not provide the total amount of calcium desired in the finished steel, adding an additional amount of calcium after desulfurization of the molten steel and before casting to the molten steel during refining.

7 Claims, 5 Drawing Sheets

Ca in FeSi Calculation for Si-containing Grades

Heat Size (tons) 170 107

FeSi Recommended Split

| % FeSi Target | Total FeSi | 1st FeSi | TF wire | 2nd FeSi | TF wire |
|---|---|---|---|---|---|
| 0.3 | 1478 | **252** | 124 | **1226** | 600 |

105 111 109

| | |
|---|---|
| **Additional Top-Feed Ca-Wire Required** | **0** |

113

| |
|---|
| **For SU heats: 800 TF Equivalent target** |
| **For PB heats: 600 TF Equivalent target** |

Compositions:

| | |
|---|---|
| Ca in TF Ca wire (lb/ft) | 0.038 |
| | |
| % Ca in FeSi | **0.62** |
| % Si in FeSi | 75 |
| Target TF Equivalent in Second Add (ft) | 600 |

101 103 123

Recovery Factors (%)

| | |
|---|---|
| FeSi | 92 |
| TF Ca Wire | 25 |
| Ca in FeSi | 75 |

121

FIG. 3A

Ca in FeSi Calculation for Si-containing Grades

Heat Size (tons) 170

FeSi Recommended Split

| % FeSi Target | Total FeSi | 1st FeSi | TF wire | 2nd FeSi | TF wire |
|---|---|---|---|---|---|
| 0.2 | 986 | 0 | 0 | 986 | 482 |

111 109

| | |
|---|---|
| **Additional Top-Feed Ca-Wire Required** | **118** |

113

| |
|---|
| **For SU heats: 800 TF Equivalent target** |
| **For PB heats: 600 TF Equivalent target** |

Compositions:

| | |
|---|---|
| Ca in TF Ca wire (lb/ft) | 0.038 |
| | |
| % Ca in FeSi | 0.62 |
| % Si in FeSi | 75 |
| Target TF Equivalent in Second Add (ft) | 600 |

Recovery Factors (%)

| | |
|---|---|
| FeSi | 92 |
| TF Ca Wire | 25 |
| Ca in FeSi | 75 |

FIG. 3B

Ca in FeSi Calculation for Si-containing Grades

Heat Size (tons) 170

FeSi Recommended Split

| % FeSi Target | Total FeSi | 1st FeSi | TF wire | 2nd FeSi | TF wire |
|---|---|---|---|---|---|
| 0.25 | 1232 | **0** | 0 | **1232** | 600 |

111 109

| | |
|---|---|
| **Additional Top-Feed Ca-Wire Required** | **0** |

113

| |
|---|
| **For SU heats: 800 TF Equivalent target** |
| **For PB heats: 600 TF Equivalent target** |

Compositions:

| | |
|---|---|
| Ca in TF Ca wire (lb/ft) | 0.038 |
| | |
| % Ca in FeSi | **0.617** |
| % Si in FeSi | 75 |
| Target TF Equivalent in Second Add (ft) | 600 |

Recovery Factors (%)

| | |
|---|---|
| FeSi | 92 |
| TF Ca Wire | 25 |
| Ca in FeSi | 75 |

FIG. 3C

REFINEMENT OF STEEL

CROSS-REFERENCE TO RELATED APPLICATIONS

This application is a continuation of International Application No. PCT/US2007/083125, filed Oct. 31, 2007, which claims priority from and the benefit of U.S. Provisional Application No. 60/863,848, filed Nov. 1, 2006. The disclosures of both applications are incorporated herein by reference.

BACKGROUND OF THE INVENTION

This invention relates generally to refining of steel. More particularly, this invention relates to processes for refinement of silicon-bearing Al-killed and Al—Si dual killed steel to be directly cast in a continuous slab caster.

In continuous slab casting, the continuous caster is comprised of a tundish and an oscillating mold, in addition to a shroud and submerged entry nozzle. The molten steel in the ladle is poured into a tundish and then poured vertically through the submerged entry nozzle into a hollow water-cooled oscillating mold, and continuously cast slabs are withdrawn horizontally from the bottom of the mold. Refractory shrouds are used to transfer the molten steel from the ladle to the tundish, and then to the submerged entry nozzle and the mold, to avoid oxidation of the molten steel through contact with air. The shroud between the tundish and the mold feeds through the submerged entry nozzle, and is regulated by a stopper rod.

The continuous slab caster produces wide rectangular strands of large cross-section, which are cut off into slabs to be hot rolled and cold rolled for use as material for sheet and plate. Thick slabs for flat-rolled products usually have an as-cast thickness of 100 to 250 mm. Thin slabs for flat-rolled products usually have an as-cast thickness of 30 to 100 mm. The slab caster is usually used in conjunction with an electric arc furnace or basic oxygen furnace, where the hot metal in produced for the caster.

Steel for continuous casting may be subjected to deoxidation treatment usually in a ladle prior to casting. Deoxidizing the molten steel in a ladle metallurgy furnace (LMF) or Vacuum Tank Degassed (VTD) to a desired oxygen level is typical. Aluminum (or a combination of Al and Si) has been widely used as a deoxidizer and grain size controller in the manufacture of steels. Aluminum acts as a sacrificial metal which combines with oxygen to form a stable aluminum oxide, which migrates into the slag. Aluminum is a particularly desirable material for this purpose because it can be safely stored, handled and transported at ambient temperature, and, it is reactive as an oxidizing agent with steel at steelmaking temperatures.

Most thin slab casting and plating grades of steel are typically Al-killed steels. In some cases a combination of Al and Si is used to kill the steel. While this steel can be cast "as is" in large slab casters, further treatment is required in thin slab casters to avoid clogging or choking of submerged entry nozzles. One established practice in thin slab casting is to modify alumina and spinel inclusions by treatment with calcium to provide for more liquidity. With proper calcium treatment, the majority of the solid alumina ($Al_2O_3$) and/or spinel ($MgAl_2O_4$) inclusions are modified to liquid inclusions and casting is performed with acceptable surface quality to the cast slab. For continuous casting in a thin slab caster, 600 feet (182.9 m) of calcium wire has been found sufficient for a 170 ton (154 tons metric) ladle to add the calcium to avoid nozzle clogging (about 0.134 lb/ton, 0.067 kg/ton metric). 600 feet (182.9 m) of calcium wire contains about 22.5 lbs (10.2 kg) of calcium and is equivalent to about 16.8 ppm effective calcium in the refined steel. The recovery of calcium in the steel from calcium wire is less than 100% so that the effective calcium will be less than the amount added.

There are two main grades of silicon-bearing steels for sheets and plate steels made in a thin slab caster:

- Silicon-restricted steel typically with less than 0.03% silicon Generally ferrosilicon or silicomanganese is not added
- Silicon-bearing steel typically with about 0.1% to 1.5% silicon Silicomanganese and/or ferrosilicon is added to achieve the desired silicon content.

Problems with stopper rod wear associated with excessive Ca-addition have been observed in silicon-bearing steels where ferrosilicon and/or Silicomanganese have been added to achieve the desired silicon concentration in the finished steel. In a "Study of Casting Issues using Rapid Inclusion Identification and Analysis", Story, et al., AISTech 2006 Proceedings, Vol. 1, pp. 879-889, it was determined that ferrosilicon can contain calcium in addition to silicon and other alloying elements. To address stopper rod wear, Story et al. discussed using high purity ferrosilicon containing about 0.024% calcium.

SUMMARY OF THE INVENTION

A method of making silicon-bearing steel comprising the steps of:

a) refining molten steel to make a silicon-bearing steel having a silicon content between 0.1% and 1.5% by weight by addition of a calcium-containing silicon additive, b) determining the amount of calcium content in the calcium-containing silicon additive, c) determining if the amount of calcium in the calcium-containing silicon additive is more or less than the amount of calcium desired in the finished steel, d) if the amount of calcium in the calcium-containing silicon additive is more than the amount of calcium desired in the finished steel, adding the amount of calcium-containing silicon additive corresponding to the excess calcium during steel deoxidation or early in the refining step to combine with oxygen, and sulfur and other impurities in the steel during the refining, e) adding the calcium-containing silicon additive containing the total amount of calcium desired in the finished steel after desulfurization of the molten steel and before casting, and f) if the amount of calcium in the calcium-containing silicon additive does not provide the total amount of calcium desired in the finished steel, adding an additional amount of calcium using Ca wire during refining after desulfurization of the molten steel and before casting to the molten steel.

The calcium-containing silicon additive may be ferrosilicon and cheap ferrosilicon additive since the percent of calcium in the additive need not be kept low. The calcium-containing silicon additive may include additives having less than about 1.8% calcium, and further includes additives with less than about 1% calcium.

The low carbon steel may have a carbon content between about 0.003% and about 0.5% by weight. The disclosed method of refining silicon-bearing steel includes low carbon steels.

The disclosed refining of silicon-bearing steel may occur in a ladle metallurgical furnace or vacuum tank degasser.

A cast steel is made by a method comprising the steps of:

a) refining molten steel to make a silicon-bearing steel having a silicon content between 0.1% and 1.5% by weight by addition of a calcium-containing silicon additive, b) determining the amount of calcium content in the calcium-containing silicon additive, c) determining if the amount of calcium in the calcium-containing silicon additive is more or less than the amount of calcium desired in the finished steel, d) if the amount of calcium in the calcium-containing silicon additive is more than the amount of calcium desired in the finished steel, adding the amount of calcium-containing silicon additive corresponding to the excess calcium early in the refining to combine with oxygen, sulfur and other impurities in the steel during the refining;

e) adding the calcium-containing silicon additive containing the total amount of calcium desired in the finished steel after desulfurization of the molten steel and before casting, and f) if the amount of calcium in the calcium-containing silicon additive does not provide the total amount of calcium desired in the finished steel, adding an additional amount of calcium after desulfurization of the molten steel and before casting to the molten steel during refining; and g) casting the molten steel into steel slabs.

Further the silicon content may be between 0.1% and 1.5% by weight.

BRIEF DESCRIPTION OF THE DRAWINGS

FIGS. 3A-3C illustrate a spreadsheet showing one embodiment of continuous casting process of the present invention.

DETAILED DESCRIPTION

To understand the operation of the disclosed methods and product, a number of embodiments are described by reference to the accompanying drawings. No limitation on the scope of the claimed invention is thereby intended. Such alterations and further modifications in the illustrated embodiments, and such further applications of method and product are contemplated as would occur to one skilled in the steelmaking art.

Figure 1:
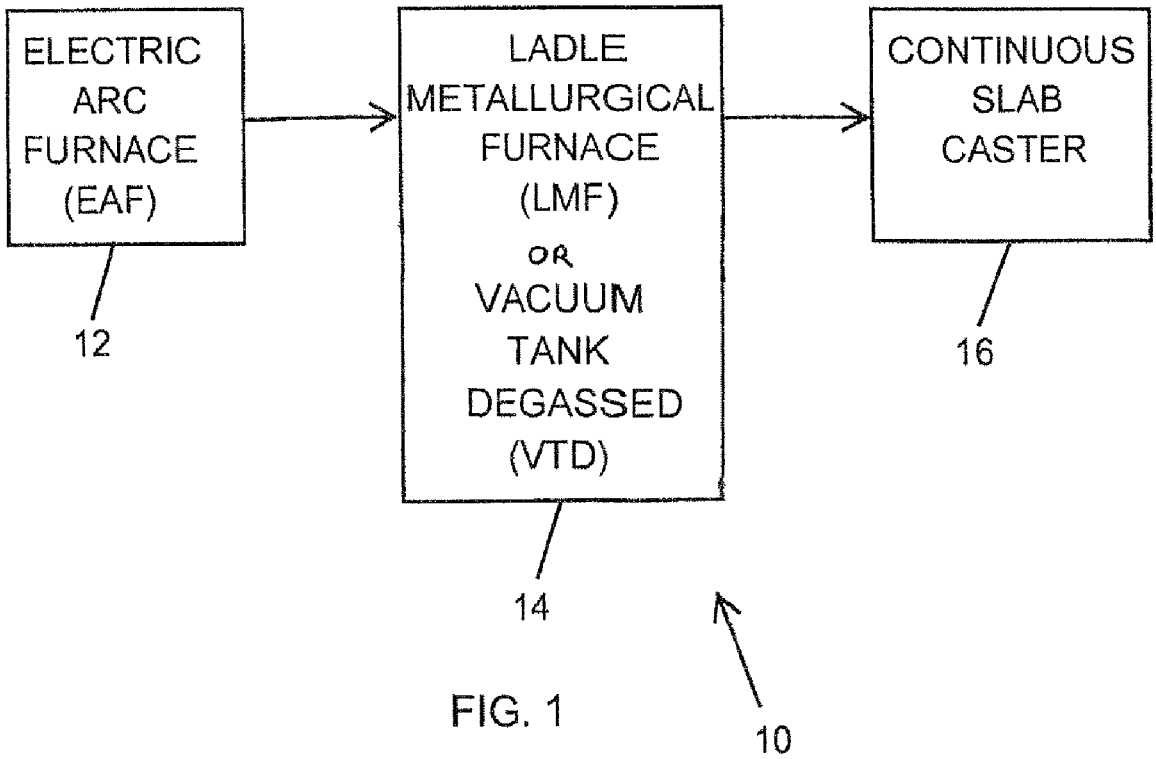
FIG. 1 is a diagrammatic illustration making of silicon-bearing steel through a refining and casting process.

Referring now to FIG. 1, silicon-bearing steel is refined and casting in process 10 as shown. Process 10 includes an electric arc furnace 12 (EAF) in which molten steel is produced. From the EAF 12, the molten steel is transferred by ladle to a ladle metallurgical furnace or vacuum tank degassed 14 (LMF or VTD), wherein the refining of molten steel is completed before continuous casting into a slab. Ladles of molten steel suitable for casting are then transferred from LMF or VTD 14 to a continuous slab caster 16 wherein the refined molten steel is cast into continuous steel slabs.

Figure 2:
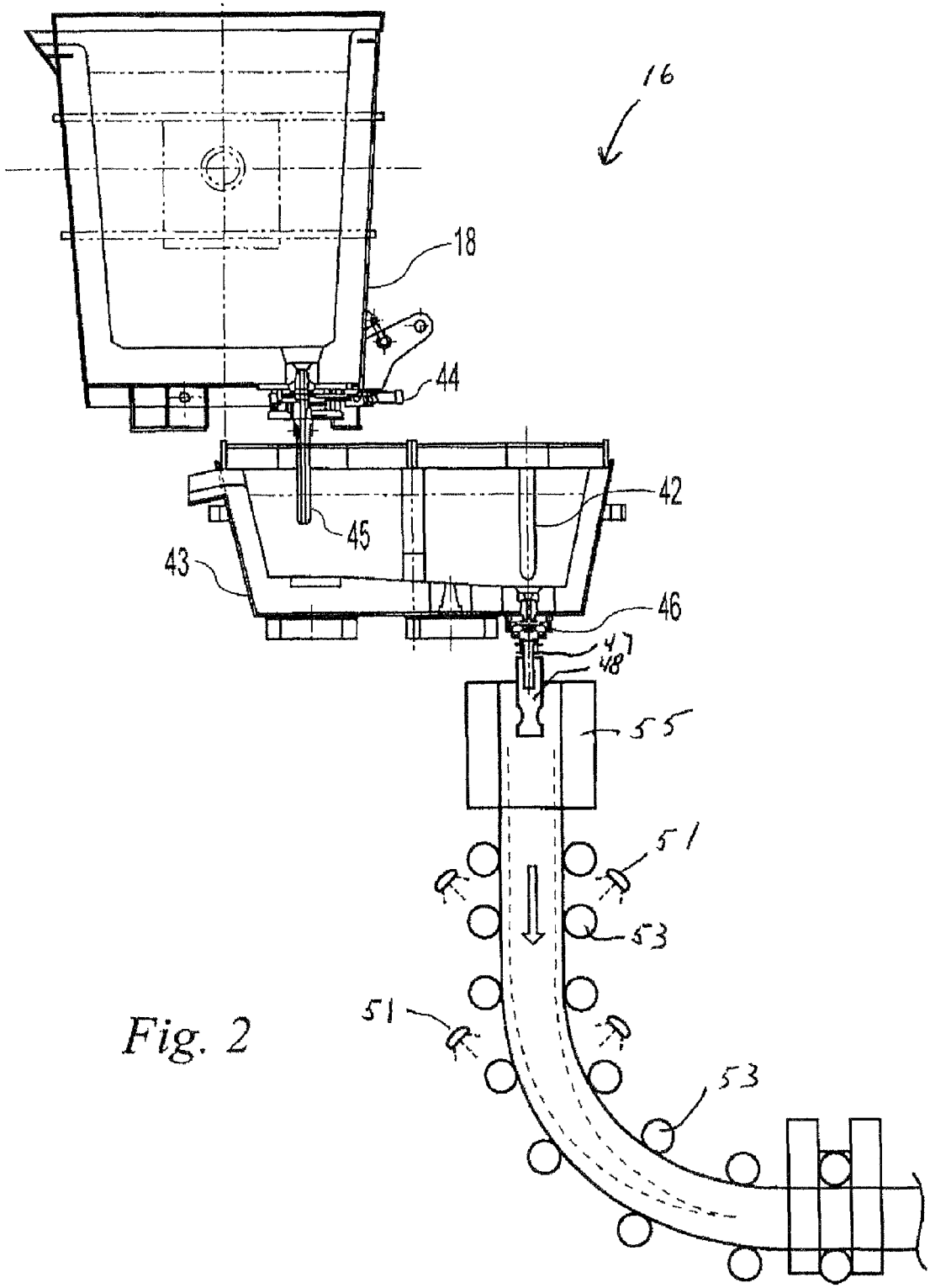
FIG. 2 is a schematic side view of a portion of the continuous slab caster of FIG. 1.

The ladle 18 of unrefined molten steel 24 is routed from the EAF 12 to the LMF or VTD 14 to refine the molten steel into a form suitable for casting by the continuous slab caster apparatus 16. In general terms, as seen in FIG. 2, casting steel continuously in such a slab caster involves introducing molten metal that is supplied during a casting operation by gravity from ladle 18 to a tundish 43, through a slide gate 44 and outlet nozzle 45. From tundish 43, the molten metal is supplied by gravity through slide gate 46 and outlet nozzle 47 to a submerged entry nozzle (SEN) 48 into continuous slab caster 16. Molten metal is introduced into the left-hand end of the tundish from the ladle 18 via an outlet nozzle 45 and slide gate valve 44. At the bottom of tundish 43, there is an outlet 46 in the floor of the tundish to allow molten metal to flow from the tundish via an outlet nozzle 47 to the SEN 48. The tundish 43 is fitted with a stopper rod 42 and slide gate valve to selectively open and close the tundish outlet and effectively control the flow of metal through the outlet. From the SEN 48, molten steel flows first through a mold 55 and then through a series of support rollers 53 and cooling sprays 51.

In slab casting described herein, the steel is generally subjected to aluminum deoxidization, which results in the formation of solid $Al_2O_3$ inclusions in the steel. Following in the refining process, the deoxidized molten steel in ladle 18 is desulfurized. After desulfurization, the steel is treated with calcium to modify the solid $Al_2O_3$ and/or spinel inclusions to liquid Ca-alumina inclusions. Following refining, the deoxidized, desulfurized and calcium treated molten steel in ladle 18 is transferred to the continuous steel slab casting apparatus 16.

In the disclosed method, the amount of calcium in the required ferrosilicon (silicon additive) is taken into account during the refining of the molten steel. The following will consider FeSi as the silicon additive.

First, the concentration of calcium in the source of ferrosilicon is determined. Next, the amount of ferrosilicon that is needed for addition to the molten steel to achieve the desired silicon concentration in the finished steel, and, the quantity of calcium in the required amount of ferrosilicon is calculated. If the amount of calcium is greater than the required amount (e.g., 16.8 ppm during normal non-startup operations), the required amount of ferrosilicon is divided into two portions, a early portion and a late portion. The late portion is the amount of ferrosilicon that contains the desired amount of calcium in the finished steel. The early portion is the amount of ferrosilicon containing the excess amount of calcium not wanted in the finished molten steel. In general, desired sources of ferrosilicon contain less than 1.8% calcium or less than 1% calcium; although this is desired, other concentrations, greater than 1.8%, can also be used in this disclosed method of forming and refining silicon-bearing steel.

The early ferrosilicon portion, $FeSi_{early}$ is added early during steel deoxidation with Al or early during refining in the ladle metallurgical furnace (LMF) or vacuum tank degasser (VTD), typically before or during desulfurization, so that the calcium in the early added ferrosilicon can combine with sulfur and other impurities, and migrate to the slag. For example, the calcium in the early added ferrosilicon can react with sulfur forming CaS that migrates to and is removed as part of the slag that is formed during refining. The late ferrosilicon portion, $FeSi_{late}$, is added late in the refining process, after desulfurization has completed, typically to less than 0.01% S by weight. The calcium added to the LMF or VTD from the $FeSi_{late}$ portion modifies the solid alumina inclusions into liquid inclusions and reduces the incidence of nozzle clogging or choking in the submerged entry nozzle. Since any excess calcium present in the total amount of ferrosilicon added to the LMF or VTD was removed during desulfurization by adding the excess portion, $FeSi_{early}$, during desulfurization, the incidence of excess stopper rod wear is reduced.

Where the calcium present in the required quantity of FeSi is equal to or less than the required amount of calcium in the finished steel, only one addition of ferrosilicon, $FeSi_{late}$ is made during refining. This single late addition of ferrosilicon is done after desulfurization. In the event that the calcium present in the required quantity of FeSi is less than the required amount, an additional amount of calcium, typically in the form of calcium wire, is added with the required quantity of FeSi.

In casting campaigns using the method of forming and refining silicon-bearing steels described, It has been found that the casting campaigns have been extended to 18 heats, which is the typical limit for the submerged entry nozzle (SEN) before replacement. Using the early processes of adding the required amount of ferrosilicon after desulfurization and followed by adding the required amount of calcium, also added after desulfurization, stopper rod wear would usually be the limiting factor and limited the casting campaign to 10 heats.

FIGS. 3A-3C show an Excel® spreadsheet illustrating an embodiment of this method of refining silicon-bearing steel in accordance with the present invention. An initial step in this process is determining the concentration of calcium in the source of ferrosilicon. Five standards of ferrosilicon containing known concentrations of calcium, 0.064%, 0.14%, 0.43%, 0.65% and 1.8%, were obtained. These standards were used to calibrate an on-site slag analyzer permitting rapid in-house analysis of ferrosilicon when ferrosilicon was received. This calibration permitted more rapid processing of ferrosilicon as received, so that ferrosilicon quantities could be readily stored and used as needed without waiting for off-site analysis before use.

Once the concentrations of calcium and silicon in the ferrosilicon are known, the concentrations are entered into the spreadsheet at 101 and 103, respectively. The desired concentration of silicon in the finished steel is entered at 105. A total quantity 107 of required ferrosilicon is then calculated. The total quantity 107 of ferrosilicon required, $FeSi_{req}$, is based on the heat size 102, multiplied by the target % silicon 105 and adjusted to account for the silicon concentration 103 in the ferrosilicon and the recovery factor 121 for ferrosilicon as follows:

$$(FeSi)_{req} = \left(\frac{\text{Heat Size} * \%\ \text{Si target}}{\%\ \text{Si in FeSi}}\right) \Big/ \%\ \text{FeSi recovery} \tag{1.0}$$

The total ferrosilicon required, $FeSi_{req}$, is then divided into a first or early ferrosilicon addition 111, $FeSi_{early}$, and a second or late ferrosilicon addition 109, $FeSi_{late}$. The late ferrosilicon addition, $FeSi_{late}$, is the amount of ferrosilicon that contains the target quantity $Ca_{target}$, 123, of calcium from the total ferrosilicon required, $FeSi_{req}$. The target quantity of calcium, $Ca_{target}$, is that amount of calcium which results in 16.8 ppm calcium continuous operation, (22.4 ppm calcium startup), in the refined metal at the time of casting. If the calcium available, $Ca_{avail}$, in the total ferrosilicon required, $FeSi_{req}$, is equal to or less than the target quantity of calcium, $Ca_{target}$, then $FeSi_{late}$ is equal to $FeSi_{req}$ and there is no early addition of ferrosilicon. If the calcium available, $Ca_{avail}$, in the total ferrosilicon required is greater than the target quantity of calcium, $Ca_{target}$, then $FeSi_{late}$ is that amount of FeSi that contains the target quantity of calcium, $Ca_{target}$. Specifically, this amount can be calculated by dividing the target calcium, $Ca_{target}$ by the calcium available, $Ca_{avail}$, multiplied by the total ferrosilicon required, $FeSi_{req}$.

$$\text{If } Ca_{avail} \leq Ca_{target},\ FeSi_{late} = FeSi_{req};\ FeSi_{early} = 0 \tag{2.0}$$

$$Ca_{avail} = FeSi_{req} * \text{concentration of Ca in ferrosilicon} * \%\ \text{Ca ferrosilicon recovery} \tag{2.1}$$

$$\text{If } Ca_{avail} > Ca_{target}, \tag{3.0}$$

$$(FeSi)_{late} = \frac{Ca_{target}}{CA_{avail}} * (FeSi)_{req};$$

$$(FeSi)_{early} = (FeSi)_{req} - (FeSi)_{late}$$

In the event that the calcium, $Ca_{avail}$, present in the total ferrosilicon required, $FeSi_{req}$, is less than the amount of calcium required, $Ca_{target}$, 123, additional calcium is added, usually in the form of calcium wire with the $FeSi_{late}$ portion ferrosilicon. For convenience, the additional calcium required 113, $Ca_{add}$ is calculated in feet of calcium wire, because a typical way of adding any additional calcium is by adding calcium wire. Other units of measurement, such as pounds, kilograms, etc. could also be used.

$$Ca_{add} = Ca_{target} - Ca_{avail} \tag{4.0}$$

FIG. 3A illustrates a situation where the calcium available, $Ca_{avail}$, is greater than the calcium required $Ca_{target}$. In this situation, the ferrosilicon required, $FeSi_{req}$ is divided into a late portion, $FeSi_{late}$ of 1226 lbs (556 kg) and an early portion, $FeSi_{early}$, of 252 pounds (114.3 kg). FIG. 3B illustrates a situation where the calcium available from the ferrosilicon, $Ca_{avail}$, is less that the calcium required, $Ca_{target}$. In this situation, there is no early portion, $FeSi_{early}$, of ferrosilicon, and additional calcium, $Ca_{add}$, of 118 feet (35.97 m) of calcium wire is required. This additional calcium is added to the molten metal when the late portion of ferrosilicon, $FeSi_{late}$ is added. FIG. 3C shows a situation where the calcium available in the total ferrosilicon required, $Ca_{avail}$, is equal to the calcium required, $Ca_{target}$. In this situation, no additional calcium, $Ca_{add}$, is required, and the early portion of ferrosilicon, $FeSi_{early}$, is zero.

The disclosed methods of making silicon-bearing steel reduce the cost of making the steel by replacing calcium wire with calcium containing ferrosilicon and by extending the length of a casting campaign to about 18 heats. It has been estimated the cost savings per ton of steel using the disclosed methods is about $2 per ton, about half due to reduced calcium wire usage and about half due to extending the length of the casting campaign.

Based upon the foregoing disclosure, it should now be apparent that method of the present invention will carry out the objects set forth hereinabove. It is, therefore, to be understood that any variations evident fall within the scope of the claimed invention and thus, the selection of specific component elements can be determined without departing from the spirit of the invention herein disclosed and described.

What is claimed is:

1. The method of making silicon-bearing steel having a carbon content between 0.003 and 0.5% by weight comprising the steps of:

a) refining molten steel to make a silicon-bearing steel having a silicon content between 0.1% and 0.5% by weight by addition of a calcium-containing silicon additive, b) determining the amount of calcium content in the calcium-containing silicon additive, c) determining whether the amount of calcium in the calcium-containing silicon additive is more or less than the amount of calcium desired in the finished steel, d) when the amount of calcium in the calcium-containing silicon additive is more than the amount of calcium desired in the finished steel, adding the amount of calcium-containing silicon additive corresponding to the excess calcium early in the refining to combine with sulfur and other impurities in the steel during the refining;

e) desulfurizing the molten steel;

f) adding the calcium-containing silicon additive containing the total amount of calcium desired in the finished steel after desulfurization of the molten steel and before casting, and g) when the amount of calcium in the calcium-containing silicon additive does not provide the total amount of calcium desired in the finished steel, adding an additional amount of calcium after desulfurization of the molten steel and before casting to the molten steel during refining.

2. The method of refining steel as claimed in claim 1 where the calcium-containing silicon additive is ferrosilicon.

3. The method of refining steel as claimed in claim 1, comprising the additional steps of:

h) determining an amount of aluminum in the calcium-containing silicon additive, and i) utilizing the amount of aluminum in the calcium-containing silicon additive in deoxidizing the molten silicon-bearing steel in refining.

4. The method of refining steel as claimed in claim 1 where the silicon-bearing steel is an Al-killed steel.

5. The method of refining steel as claimed in claim 1 further comprising adding a manganese-containing additive early in the refining.

6. The method of refining steel as claimed in claim 1 where the step of refining molten steel occurs in a ladle metallurgical furnace.

7. The method of refining steel as claimed in claim 1 where the silicon content is between 0.1% and 0.5% by weight.

* * * * *